United States Patent [19]

Gallina

[11] 4,418,838

[45] Dec. 6, 1983

[54] SINGLE TABLET DISPENSING BOX

[75] Inventor: Ferenc Gallina, Bötzingen, Fed. Rep. of Germany

[73] Assignee: Van Leer Verpackungen GmbH, Hamburg, Fed. Rep. of Germany

[21] Appl. No.: 281,052

[22] Filed: Jul. 7, 1981

[51] Int. Cl.[3] ..... B65H 3/00

[52] U.S. Cl. ..... 221/246; 221/251; 221/269; 221/289

[58] Field of Search ..... 221/292, 293, 289, 299, 221/247, 276, 263, 269, 298, 251, 246; 206/536, 537

[56] References Cited

U.S. PATENT DOCUMENTS

| | | | |
|---|---|---|---|
| 2,044,929 | 6/1936 | Young | 221/289 |
| 2,669,349 | 2/1954 | Silver | 221/276 |
| 3,159,308 | 12/1964 | Passavarti | 221/289 |
| 3,191,802 | 6/1965 | Lasting | 221/299 |
| 3,319,827 | 5/1967 | Englesson | 221/299 |

*Primary Examiner*—H. Grant Skaggs

*Attorney, Agent, or Firm*—Brumbaugh, Graves, Donohue & Raymond

[57] ABSTRACT

Tablet box with cover and sliding element whereby the bottom and one of the side walls of the box together with a bar of said sliding element are forming a trough in which the tablets are slipping and from the under end of which one single tablet is dispensed when the sliding element is operated, whereas the special form of the component parts prevents falling out of further tablets from said box.

5 Claims, 13 Drawing Figures

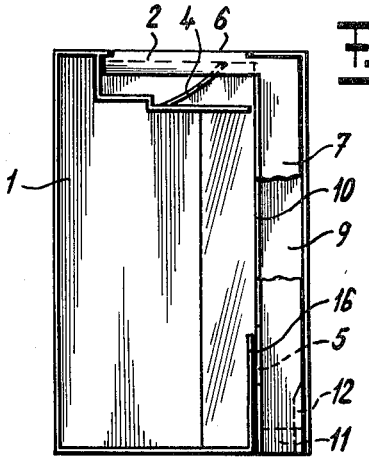
Fig-1
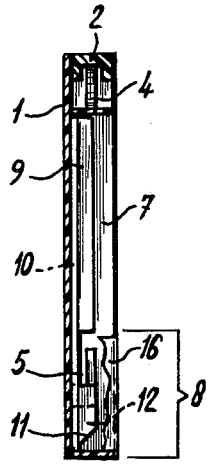
Fig-2
Fig-3
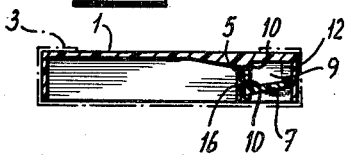
Fig-4
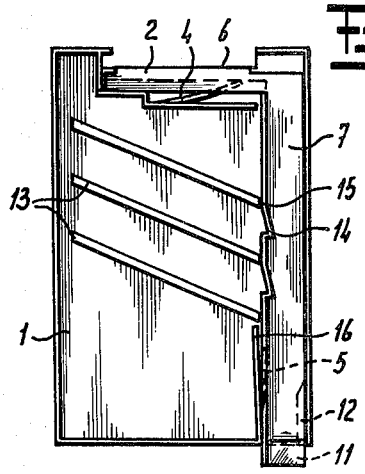
Fig-5
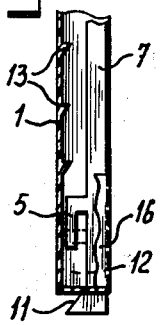
Fig-6
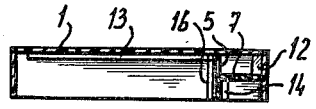

SINGLE TABLET DISPENSING BOX

BACKGROUND OF THE INVENTION

The invention relates to a single tablet dispensing box for dispensing tablets in arbitrary form, for instance circular, angular or spherical shaped tablets, whereby pressing a knob results into dispensing one single tablet.

There are already various single tablet dispensing boxes, especially for dispensing circular tablets. The known embodiments suited for dispensing angular tablets have the disadvantage, that they have to be tilted for each dispensing procedure. Other embodiments are much too complicated, therefore too voluminous and too expensive and thus not economical. Furthermore said known boxes also have to be shaked before dispensing a tablet to pre-arrange the tablets.

SUMMARY OF THE INVENTION

The object of the invention is now to eliminate said disadvantages, and especially to offer a handy and profitable single tablet dispensing box suited for dispensing circular tablets but also suited for dispensing angular and spherical tablets.

According to the invention a known tablet box with cover is equiped with a sliding element whereby the bottom and one of the side walls of the box, together with a bar of said sliding element, form a trough in which the tablets slip and in which they are collected into the correct position and from the under end of which one single tablet is dispensed when the sliding element is operated, whereas the special form of the component parts prevent further tablets from falling out of the box.

The sliding element has at the upper side of the box an extended press surface and has at its under side a simple output mechanism. When a person presses the press surface, the sliding element moves downwards, and at the under side an output opening is created through which a single tablet may slip out of the box over a sloping surface, whereby simultaneously the second tablet is held by means cooperating with said sliding element. When said sliding element is released, an integrally formed spring brings said sliding element back into the starting position.

BRIEF DESCRIPTION OF THE DRAWINGS

Embodiments of the invention are illustrated in the accompanying drawings.

FIG. 1 shows a front view of a first embodiment of an open box in the non-activated position.

FIG. 2 shows a sectional side view of FIG. 1.

FIG. 3 shows a sectional plan view of FIG. 1.

FIG. 4 shows a front view similar to the view of FIG. 1, of an alternative embodiment in the activated position.

FIG. 5 shows a sectional side view of part of FIG. 4.

FIG. 6 shows an upper view of FIG. 4.

DETAILED DESCRIPTION OF EXEMPLARY EMBODIMENTS

Figure 7:
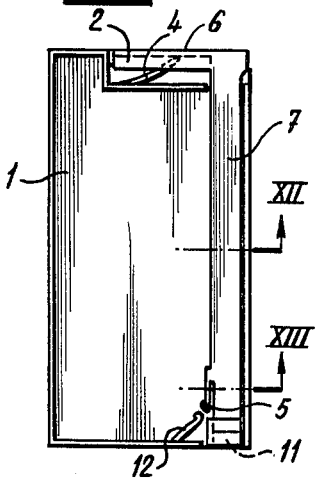
FIG. 7 shows a front view of a second embodiment of an open box in the non-activated position.

The single tablet dispensing box illustrated in FIG. 1 until 6 comprises the container 1, the sliding element 2 and the cover 3. The sliding element 2 has an integrally formed reset spring 4. The upper part with the press surface 6 is through a bar 7 connected to the output part 8. The bar 7 defines together with the bottom and the side wall of the container 1 the collecting trough 9. By slanting said dispensing box, assisted by the steps 13 at the bottom of the container the tablets are directed into the collecting trough 9. The steps 14, integrally formed onto the bar 7 function to turn standing tablets so that these tablets also slip into the collecting trough 9. To assure that no tablets are slipping out of the collecting trough 9 a step 10 is integrally formed to the bottom of the container and to the bar 7 over the whole length thereof. The same effect can be obtained by the end surfaces 15 of the steps 13. The trough is closed by a slanting surface 11 at the under side of the sliding element 2, over which slanting surface the lowest tablet may fall out of the box when the sliding element 2 is pressed in. According to the invention the inner surface of the container 1 comprises an inwards extending 12 reaching unto the level of the second tablet in the collecting trough 9 and furthermore the sliding element 2 has a resilient side wall 5 reaching from the above mentioned level unto above said second tablet. Said extending element 12 and said side wall 5 have in the non-activated position of the sliding element 2 a mutual distance in excess of the tablet dimension. Below said side wall 5 in the direction of the output opening the collecting trough is limited by a bar 16 integrally formed onto the lower side wall of the container, whereby the distance between said bar 16 and the extending element 12 is in excess of the tablet dimension increased by the thickness of the side wall 5. In the pressed-in position of the sliding element 2 said wall 5 is situated opposite the extending element 12 whereby the mutual distance is smaller than the tablet dimension. When a tablet is caught in between, the side wall 5 will resiliently move back, so that said tablet is held.

Figure 8:
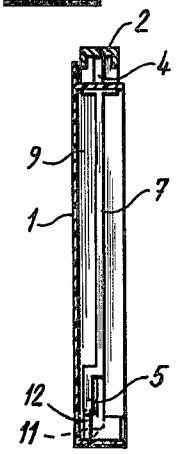
FIG. 8 shows a sectional side view of FIG. 7.
Figure 9:
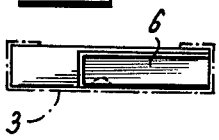
FIG. 9 shows a sectional upper view of FIG. 7.
Figure 12:
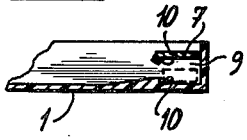
FIG. 12 shows a sectional view through the box and sliding element in FIG. 7 taken along the line XII.
Figure 10:
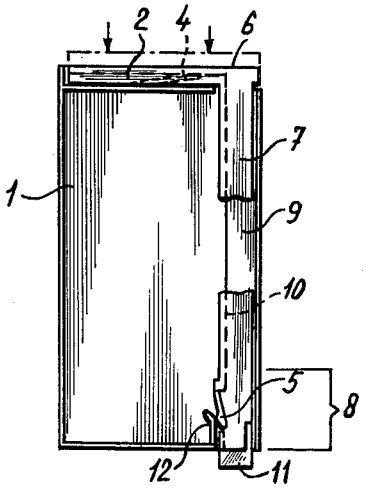
FIG. 10 shows a front view of the open box with pressed in sliding element.
Figure 13:
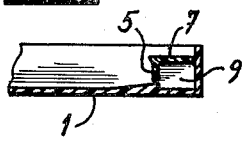
FIG. 13 shows a sectional view through the box and sliding element in FIG. 7 taken along the line XIII.
Figure 11:
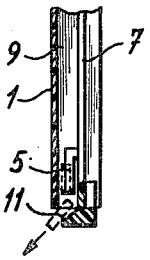
FIG. 11 shows a sectional side view of FIG. 10.

In the FIGS. 7 through 13 a further embodiment of the single tablet dispensing box according to the invention is illustrated. In said FIGS. the same reference numbers are used as in FIGS. 1 through 6. Said second embodiment of the single tablet dispensing box comprises a container 1, a sliding element 2 and a cover 3. The sliding element 2 has a reset spring 4, a holding spring 5 and a press surface 6 for operating said sliding element. The press surface 6 is only by means of the bar 7 connected to the output part 8. Said bar 7 forms the upper surface of the collecting trough 9. To assure that the tablets cannot slid back out of the collecting trough 9 steps 10 are integrally formed onto the bottom of the container and onto the bar 7 extending over the whole length thereof. The container is closed by a slanting surface 11 at the under end of the sliding element 2, over which slanting surface the lowest tablet may fall out when the sliding element 2 is pressed-in. At the level of the second tablet in the collecting trough 9 a holding spring 5 is integrally formed with said sliding element 2 extending sidewards, which holding spring 5 holds the second tablet when the sliding element 2 is moved downwards, because in that case said holding spring 5 is moved inwards by means of the actuating bar 12, integrally formed onto the lowest side wall of the container 1.

I claim:

1. A single tablet dispensing box for tablets comprising a flat box-shaped container having side walls, a bottom and a cover and defining a storage space for tablets, an L-shaped sliding element movable against spring pressure along a rectilinear path defined by guiding walls in the container, wherein the short leg of the L-shaped sliding element forms a press surface for operating the element through an opening in a side wall of the container, and wherein the long leg of the L-shaped sliding element extends perpendicular to a flat, main wall of the container and has at its outer end a slanting surface controlling an outlet opening of the container, the space between said leg and said wall forming a collecting trough which is slightly larger than the thickness of a tablet so as to form a row of tablets on said leg, said container and said long leg having cooperating means adjacent the slanting surface which upon movement of the element narrows the space above the slanting surface to a dimension smaller than the dimension of a tablet.

2. The single tablet dispensing box as claimed in claim 1, wherein the cooperating means includes the lower end of the long leg of the sliding element at the level of a second tablet in said trough being provided with a holding spring, and the lower side wall of the container being provided with an actuating bar extending into the path of said holding spring so as to move said spring inwardly into the trough upon movement of the sliding element against spring pressure to dispense a tablet.

3. The single tablet dispensing box as claimed in claim 1, wherein the cooperating means is formed by the container bottom adjacent to the dispensing opening having a bar extending inwardly into the container and reaching up to the level of the second tablet present in said trough, and wherein above said level the sliding element having a side wall with a resilient lower part, the inner surface of the container opposite said resilient lower part of the side wall having an inwardly extending portion reaching up to the level of the second tablet, said resilient lower part being bent inwardly towards the upwardly extending element upon operation of the sliding element.

4. The single tablet dispensing box as claimed in claim 1, wherein the bottom of the container includes steps which guide tablets toward the collecting trough.

5. The single tablet dispensing box as claimed in claim 1, wherein the bottom of the container includes a step-like portion which extends parallel to and adjacent to the long leg of the sliding element, said portion having a gradual slope towards a central part of the container and a steep slope at the side of the collecting trough.

* * * * *

UNITED STATES PATENT AND TRADEMARK OFFICE

CERTIFICATE OF CORRECTION

PATENT NO. : 4,418,838

DATED : December 6, 1983

INVENTOR(S) : Ferenc Gallina

It is certified that error appears in the above—identified patent and that said Letters Patent is hereby corrected as shown below:

First page, following Item 22, insert --[30] Foreign Application Priority Data July 9, 1980 Fed. Rep. of Germany G 80 18 373.9 December 4, 1980 Fed. Rep. of Germany G 80 32 254.9--;

Column 2, line 27, after "extending" insert --element--.

Signed and Sealed this

First Day of May 1984

[SEAL]

Attest:

GERALD J. MOSSINGHOFF

Attesting Officer

Commissioner of Patents and Trademarks